US007740351B2

(12) United States Patent
Shinohara et al.

(10) Patent No.: US 7,740,351 B2
(45) Date of Patent: Jun. 22, 2010

(54) INK-JET PRINTING MACHINE AND PRINTING METHOD

(75) Inventors: Masaaki Shinohara, Ibaraki-ken (JP); Kinya Ono, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 643 days.

(21) Appl. No.: 11/589,741

(22) Filed: Oct. 31, 2006

(65) Prior Publication Data

US 2007/0103534 A1 May 10, 2007

(30) Foreign Application Priority Data

Nov. 7, 2005 (JP) ..... P2005-322938

(51) Int. Cl.
*B41J 2/01* (2006.01)

(52) U.S. Cl. ..... 347/104; 347/101

(58) Field of Classification Search ..... 347/104, 347/101

See application file for complete search history.

(56) References Cited

U.S. PATENT DOCUMENTS 5,534,894 A * 7/1996 Hirano et al. ..... 346/134
6,923,584 B2 * 8/2005 Namekawa et al. ..... 400/625
7,458,672 B2 * 12/2008 Hirakawa ..... 347/101
2003/0128253 A1 7/2003 Kitahara et al.

FOREIGN PATENT DOCUMENTS

JP 08-198477 8/1996
JP 2004-276486 10/2004

* cited by examiner

*Primary Examiner*—Manish S Shah
(74) *Attorney, Agent, or Firm*—The Nath Law Group; Jerald L. Meyer; Sungyeop Chung

(57) ABSTRACT

An ink-jet printing machine has: a transfer belt that transfers a printing sheet; a sheet feeding unit that feeds the printing sheet; an ink-jet head that performs ink ejection on the printing sheet; a SS roller that presses a central region of the printing sheet between the sheet feeding unit and the ink-jet head; a printing sheet sensor that detects the deformation of the printing sheet; and a guide roller that presses the printing sheet. The rate of a distance A between the SS roller and the printing sheet sensor to a distance B between the upper surface of a transfer belt and the lower end of the printing sheet sensor is approximately equal to the rate of a distance A' between the guide roller and the ink-jet head to a distance B' between the upper surface of the transfer belt and the lower end of the ink-jet head.

6 Claims, 8 Drawing Sheets

INK-JET PRINTING MACHINE AND PRINTING METHOD

BACKGROUND OF THE INVENTION

1. Field of the Invention

The present invention relates to an ink-jet printing machine and a printing method in which a plurality of inks are ejected from ink-jet heads in order on a printing sheet transferred along a transfer path.

2. Description of the Related Art

A printing machine disclosed in Japanese Patent Laid-Open Publication No. 2004-276486 shows a printing method in which color inks are ejected on a printing sheet from ink-jet heads aligned along a transfer path formed by a transfer belt. The printing machine transfers the printing sheet fed by a sheet feeding part, performs printing during the transfer, and discharges the printed sheet from a sheet discharging part. With increased demand for high-speed printing, this printing machine is equipped with a transfer belt that performs a high-speed transfer.

Printing sheets often get deformed because of wetness or dryness due to humidity changes. FIG. 1 shows such a printing sheet 2002 with wrinkles 2021 on the edge. As shown in FIG. 2B, when the printing sheet 2002 is transferred into the ink-jet printing machine by a transfer belt 2106*a*, a deformed portion of the printing sheet 2002 leaves from the upper surface of the transfer belt 2106*a* and hence contacts with an ink-jet head 2104. This contact causes damage to the ink-jet heads or leads to blocking of ink ejection.

In order to detect the deformation of the printing sheet, Japanese Patent Laid-Open Publication No. H08-198477 shows a printing machine having an optical sensor.

In order to minimize the leaving of the printing sheet under the ink-jet head, a conventional printing machine has a guide roller provided upstream of the ink-jet head or a steel plate 2053 covering the transfer path to keep pressing the deformation as shown in FIG. 3.

SUMMARY OF THE INVENTION

However, the above devices have their own disadvantages as follows:

The optical sensor has difficulty in measuring an exact distance to a printing sheet due to influence of colors on the printing sheet or colors of the printing sheet itself. Moreover, the optical sensor has difficulty in keeping up with the high-speed printing because the optical sensor has a process of picking up information with voltage and a process of computing the distance;

The guide roller has a limit of keeping pressing the deformation. Accordingly, when the deformation exceeds a predetermined volume, the deformed printing sheet contacts with the ink-jet head. Although in general the deformation depends on material of the printing sheet or its use environment, it is preferable to provide the guide roller as close to the ink-jet head as possible. However, there is a limit to bring them closer because of structural restrictions of the printing machine. It is therefore difficult to deal with the deformation of all kinds of sheet only by positioning of the guide roller;

The steel plate lowers the quality of printing by so called the "mist stain". The mist stain is a phenomenon that local airflow generated in the aperture of the steel plate disturbs ink flow near the ink-jet head. This phenomenon is cause by the insufficient ratio of the aperture at the transfer path because the steel plate covers an area of the transfer path broader than an area under the ink-jet heads. This generates a local airflow near the apertures to disturb the ink ejection and make stains.

An object of the present invention is to prevent the damage to ink-jet heads due to the printing sheet leaving from during ink-jet printing.

To achieve the above-described object, a first aspect of the present invention provides an ink-jet printing machine comprising: a transfer belt unit including an orbital transfer belt which serves as a transfer path of a printing sheet; a sheet feeding unit configured to feed the printing sheet onto the transfer path; a ink-jet head disposed above the transfer path and configured to perform ink ejection on the printing sheet transferred on the transfer path; a sheet pressing roller disposed across the transfer path between the sheet feeding unit and the ink-jet head, and configured to press a central region of the printing sheet transferred on the transfer path; a detecting unit disposed between the sheet pressing roller and the ink-jet head and away from an upper surface of the transfer belt by a predetermined distance, and configured to detect a deformation of the printing sheet that exceeds the predetermined distance by contacting with a deformed part of the printing sheet; and a guide roller disposed across the transfer path between the detecting unit and the ink-jet head and configured to press the printing sheet transferred on the transfer path, wherein a ratio of a distance between the sheet pressing roller and the detecting unit to a distance between the upper surface of the transfer belt and the detecting unit is approximately equal to a ratio of a distance between the guide roller and one ink-jet head of the ink-jet head to a distance between the upper surface of the transfer belt and said ink-jet head.

A second aspect of the present invention provides an ink-jet printing method providing a printing sheet on a transfer path formed by an orbital transfer belt, transferring the printing sheet along the transfer path, performing ink ejection from an ink-jet head disposed above the transfer path on the printing sheet transferred on the transfer path, the method comprising: pressing a central region of the printing sheet transferred on the transfer path by a sheet pressing roller disposed across the transfer path between a sheet feeding unit and the group of ink-jet heads; detecting a deformation of the printing sheet exceeding a predetermined distance by contact of a deformed part of the printing sheet and a detecting unit, which is disposed between the sheet pressing roller and the ink-jet head and away from an upper surface of the transfer belt by the predetermined distance; and pressing the printing sheet transferred on the transfer path by a guide roller disposed across the transfer path and between the detecting unit and the group of ink-jet heads, wherein a ratio of a distance between the sheet pressing roller and the detecting unit to a distance between the upper surface of the transfer belt and the detecting unit is set approximately equal to a ratio of a distance between the guide roller and one ink-jet head of the group of ink-jet heads to a distance between the upper surface of the transfer belt and said ink-jet head.

DETAILED DESCRIPTION OF THE PREFERRED EMBODIMENTS

Figure 1:
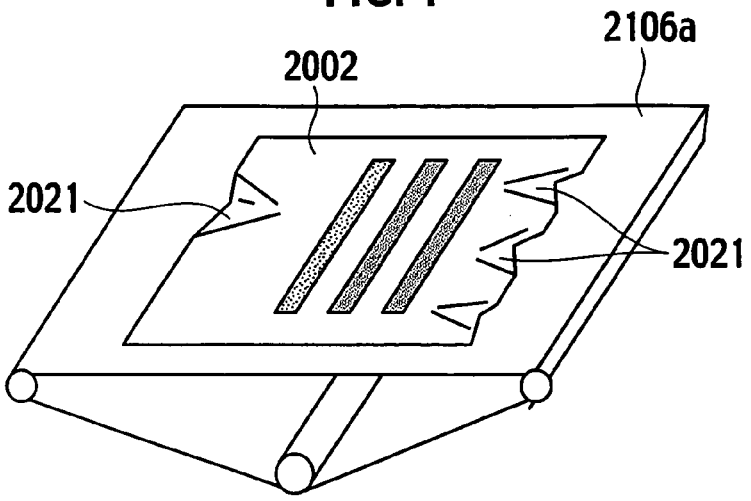
FIG. 1 is a view showing deformation of a printing sheet.
Figure 2A:
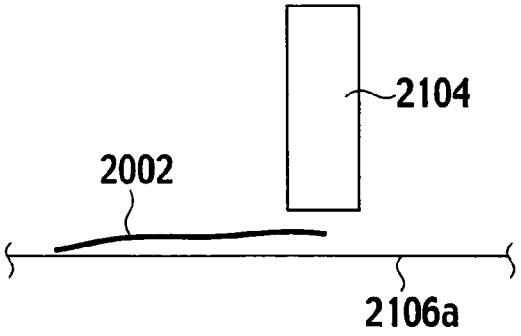
FIG. 2A is a view showing a printing sheet leaving from the upper surface of a transfer path of a conventional printing machine.
Figure 2B:
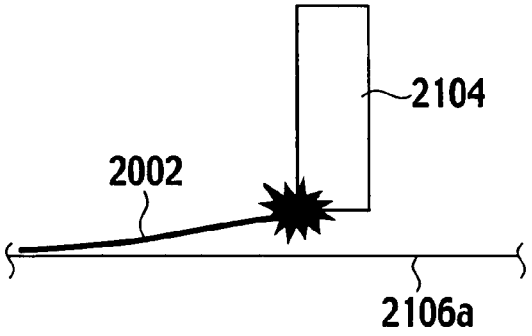
FIG. 2B is a view showing damage to an ink-jet head of the conventional printing machine.
Figure 3:
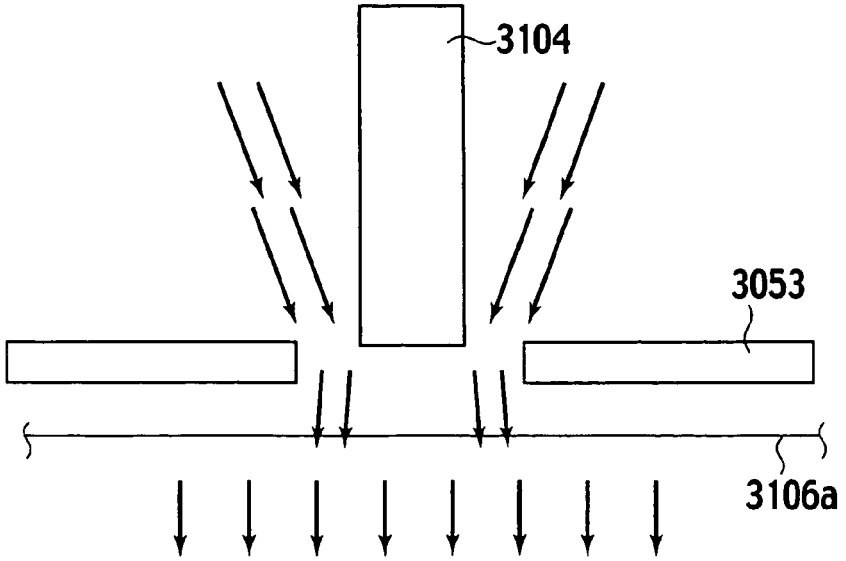
FIG. 3 is a view showing airflow near an ink-jet head on another conventional printing machine.
Figure 4A:
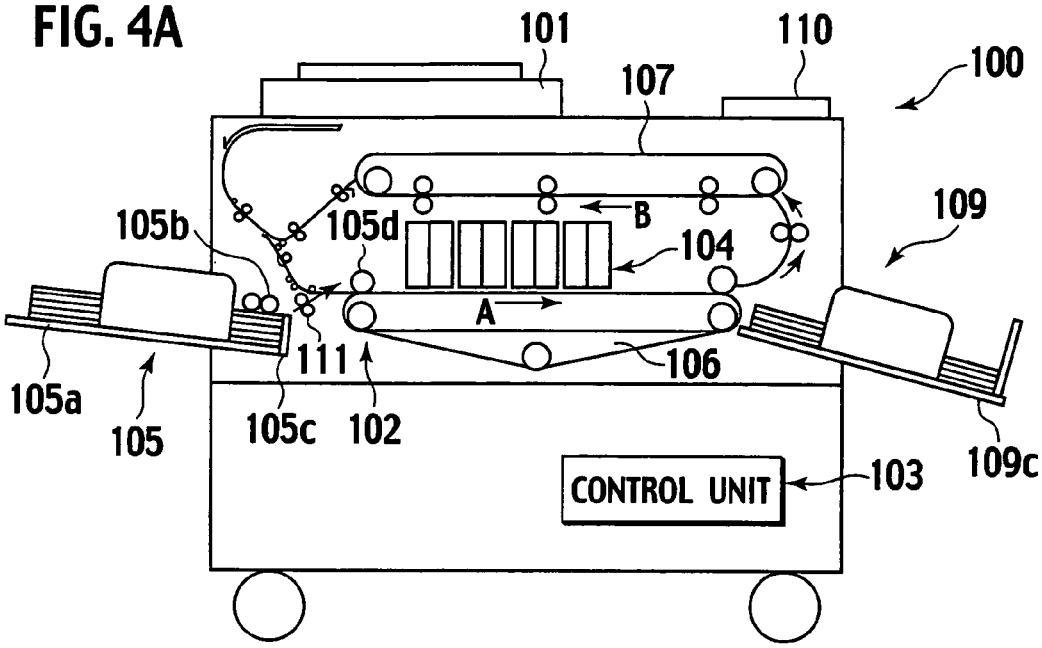
FIG. 4A is a side view showing the whole structure of an ink-jet printing machine in one embodiment according to the present invention.
Figure 5:
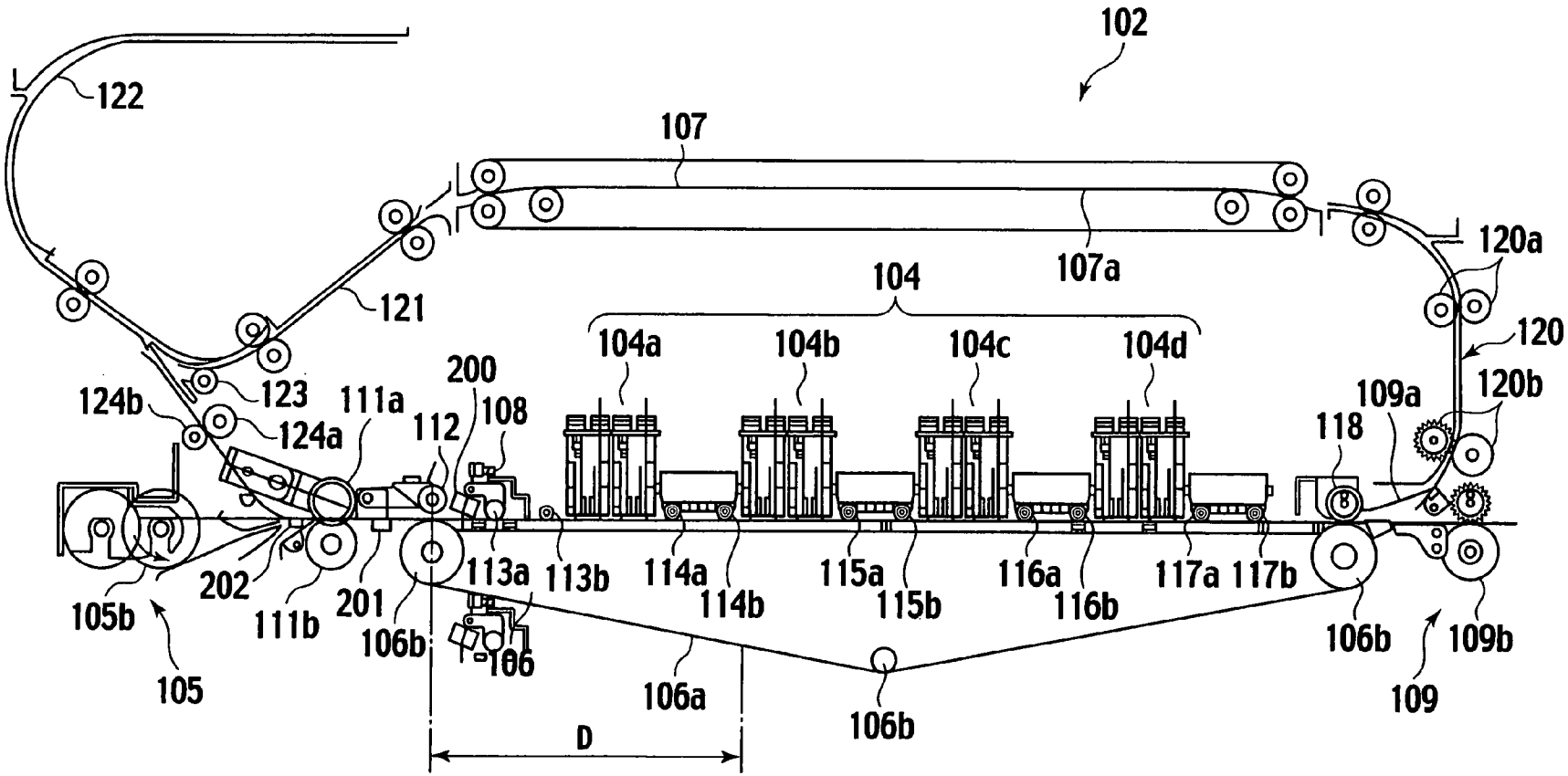
FIG. 5 is a side view showing the structure of a printing unit of the ink-jet printing machine in the embodiment in detail.

With reference to FIGS. 4A and 5, there is described an ink-jet printing machine 100 in one embodiment according to the present invention.

[Structure of the Ink-Jet Printing Machine]

As shown in FIG. 4A, the ink-jet printing machine 100 comprises: an image reading unit 101 on an upper portion of the machine body; a printing unit 102 which performs printing inside the machine body; a sheet feeding unit 105 which feeds printing sheets to the printing unit 102; a transfer belt unit 106 which transfers the printing sheets; a sheet discharging unit 109 which discharges the printed printing sheets; a control unit 103 which controls operations of these units; and a touch panel 110 through which predetermined instructions, such as print instruction, are input. Each unit is described below in detail.

(Sheet Feeding Unit)

The sheet feeding unit 105, which has a sheet feeding tray 105*a*; a sheet feeding roller 105*b*; and paired resistive rollers 111, is a module to stock the printing sheets and feed the printing sheets to the print unit 102 one sheet at a time.

The sheet feeding tray 105*a* on which the printing sheets are piled up is driven in an up-and-down direction by a driving unit (not shown). In the front of the sheet feeding tray 105*a* in a transfer direction of the printing sheets, there is provided a front blocking wall 105*c* in a standing manner for positioning leading ends of the printing sheets piled up thereon.

Figure 4B:
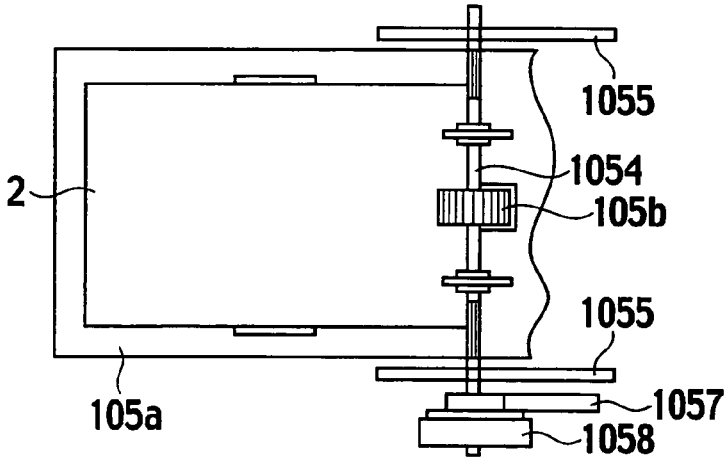
FIG. 4B is a top view showing a sheet feeding tray in the embodiment.

Above the piled up printing sheets, there is provided the sheet feeding roller 105*b* made of rubber or similar material. As shown in FIG. 4B, the sheet feeding roller 105*b* is rotatably mounted by a support axis 1054 between side plates 1055, 1055 for drawing the printing sheet one by one. The support axis 1054 is connected, at one end thereof, to a driven end of an electromagnetic clutch 1058, which is further connected to a driving end of the electromagnetic clutch 1058 through a drive transmission belt 1057. The support axis 1054 of the sheet feeding roller 105*b* is driven to rotate only when the electromagnetic clutch 1058 is in a current carrying state, that is when the driven and driving ends of the electromagnetic clutch 1058 are engaged.

The timing of the rotary drive of the sheet feeding roller 105*b* is determined by the control unit 103 as follows: Sensors 201 and 202 (FIG. 5) cooperatively work to detect leading and trailing ends of the printing sheet; send the detected result to the control unit 103; the control unit 103 performs an operation to obtain the position of the printing sheet, and then determines the timing of the sheet feeding.

Facing to the sheet feeding roller 105*b*, there is provided a pad holder (not shown). The pad holder (not shown) is supported movable in a radial direction of the sheet feeding roller 105*b* and biased to the outer peripheral surface of the sheet feeding roller 105*b* by spring force of a pressed coil spring. On the upper surface of the pad holder (not shown), there is provided a pad (not shown) made of rubber or rubber-like material, or cork with a relatively large friction coefficient.

Downstream of the sheet feeding roller 105*b* in a sheet feeding direction, there is provided a sheet feeding path comprising a lower guiding plate and an upper guiding plate. The sheet feeding path continues from the sheet feeding roller 105*b* toward an ink-jet head unit 104. Around the end of the sheet feeding path, there are provided paired resistive rollers 111 comprised of an upper and a lower resistive rollers 111*a*, 111*b* with their outer peripheral surfaces contacting each other. The resistive roller 111*b* is configured to be driven to rotate intermittently by a driving unit (not shown).

To allow deformation of the printing sheet 2 in its transfer direction between the sheet feeding roller 105*b* and the paired resistive rollers 111, the upper guiding plate is arched upward, and the sheet feeding path extends upward and downward at near end of the paired resistive rollers 111. Note that the sheet feeding timing sensor 202 (FIG. 5) is provided in front of (upstream of) the contact part of the resistive rollers 111*a*, 111*b*. The printing timing sensor 201 (FIG. 5) is provided between the paired resistive rollers 111 and a transfer belt roller 106*b* described below. The printing timing sensor 201 and the sheet feeding timing sensor 202 cooperatively work to detect the leading and trailing ends of the printing sheet. The paired resistive rollers 111 are provided for positioning the end of the printing sheet drawn by the sheet feeding roller 105*b*.

(Transfer Unit)

As shown in FIG. 5, the transfer belt unit 106 has a transfer belt 106*a*, the transfer belt rollers 106*b* which drive the transfer belt 106*a* to go around, a drawing unit (not shown), a transfer drive unit (not shown), a printing sheet transfer mechanism roller (SS roller) 113*a*, and a transfer roller (BU roller) 112.

The transfer belt 106*a* and the transfer belt rollers 106*b* cooperatively configure a belt conveyer that is the transfer path for transferring the printing sheets, and control the transfer direction of the printing sheet 2 during ink ejection. More particularly, the transfer belt 106*a* is formed by a looped belt (orbital belt) with many holes, through which the drawing unit (not shown) draws air. The printing sheets are transferred sticking to the transfer belt 106*a* by this negative pressure. The transfer belt roller 106*b* is driven by rotation of the transfer drive unit (not shown) such as a motor. It is noted that, on a transfer belt unit 106, there is provided an encoder 132 (FIG. 6) which detects rotation of each roller and outputs pulse per predetermined angle to the motor of the transfer drive unit (not shown).

The resistive rollers 111*a*, 111*b* and the BU roller 112 configure feeding means to feed the printing sheet 2 to the transfer belt 106*a*. The feeding means bends the printing sheets 2 therebetween.

Figure 7A:
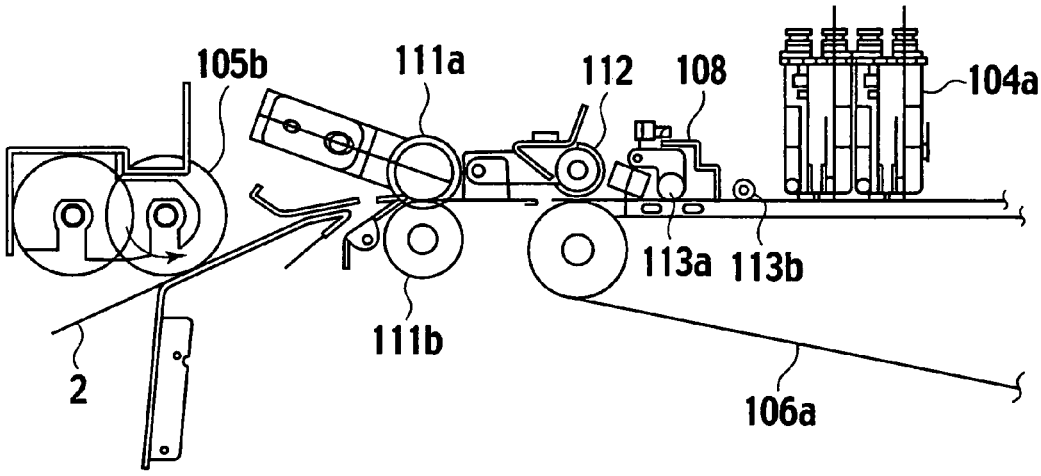
FIGS. 7A and 7B are a side view showing the operation of a supplying unit (a pair of resistive rollers and a BU roller) in the embodiment.
Figure 7B:
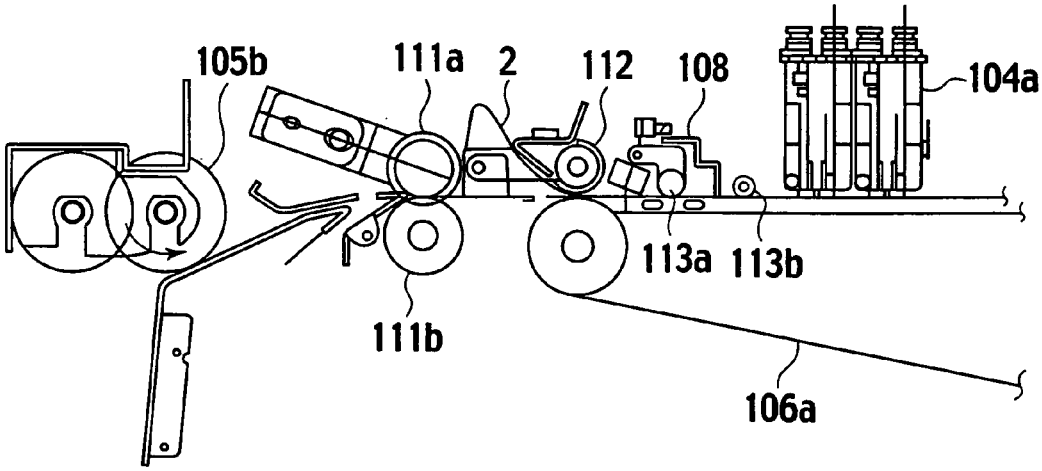

More particularly, as shown in FIG. 7A, the BU roller 112 is disposed facing to the resistive rollers 111*a*, 111*b* and away from the resistive rollers 111*a*, 111*b* by a predetermined distance. The printing sheet 2 is transferred to the resistive rollers 111*a*, 111*b* by the sheet feeding roller 105*b*. Peripheral velocity of the paired resistive rollers 111*a*, 111*b* is set faster than that of the transfer belt 106*a*. As shown in FIG. 7B, this difference of peripheral velocity causes to bend the printing sheet 2 between the resistive rollers 111*a*, 111*b* and the transfer belt 106*a*. When the leading end of the printing sheet 2 contacts with the BU roller 112, the printing sheet is drawn to the upper surface of the transfer belt 106*a*, thereby following the peripheral velocity of the transfer belt 106*a*. The BU roller 112 corrects the transfer direction of the printing sheet 2 to the transfer direction of the transfer belt 106*a*. Then, the printing sheet 2 transferred by the BU roller 112 is stuck to the transfer belt 106*a* with no space by the SS roller 113*a*. Between the SS roller 113*a* and the BU roller 112, there is provided a sheet width sensor 200 (FIG. 5) which detects the width of the printing sheet 2.

Figure 10:
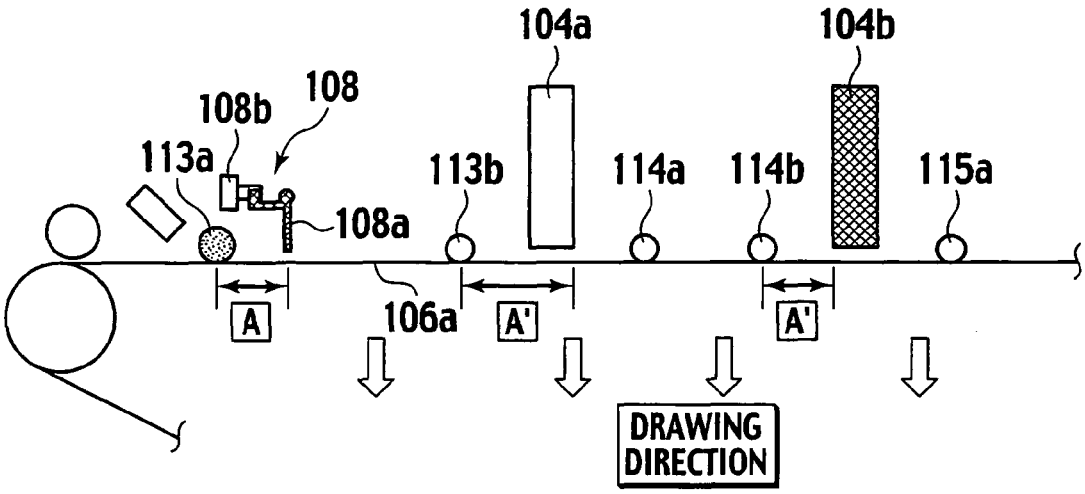
FIG. 10 is a view showing the detecting mechanism of deformation in the embodiment.

In this embodiment, there is further provided a deformation-detecting mechanism that prevents the damage of ink-jet head when a deformed printing sheet is transferred. With reference to FIG. 10, there is described the mechanism in detail.

Figure 8:
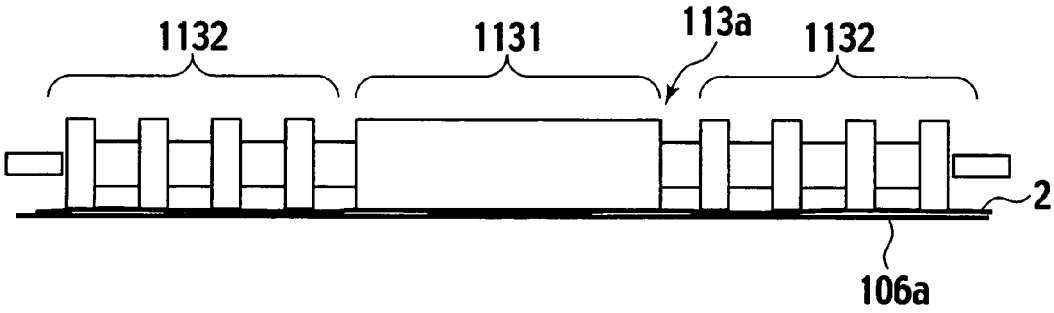
FIG. 8 is a front view showing the structure of a SS roller in the embodiment.

The SS roller 113*a* is a roller disposed across the transfer path between the BU roller 112 and the ink-jet head 104*a*, which presses a central region of the printing sheet. In particular, as shown in FIG. 8, the SS roller comprises a central part (printing sheet pressing part) 1131 for pressing the central region of the printing sheet and both end parts 1132, 1132 with some grooves thereon. The central part is larger in width than that of each groove.

Figure 11A:
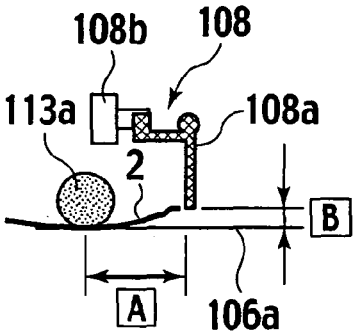
FIGS. 11A and 11B are a side view showing the structure and operation of a printing sheet sensor in the embodiment.

As shown in FIG. 10, between the SS roller 113*a* and the ink-jet head 104*a*, there is provided a printing sheet sensor 108. As shown in FIG. 11A, the printing sheet sensor 108 is away from the upper surface of the transfer belt 106*a* by a predetermined distance "B". By contacting with a deformed portion of the printing sheet 2 that exceeds the distance B, the printing sheet sensor 108 detects the deformation of the printing sheet. In particular, the printing sheet sensor 108 comprises a swing part 108*a* and a swing sensor part 108*b*. The swing part 108*a* is crank-shaped in section and supported to swing in the transfer direction. The swing sensor part 108*b* detects the swing of the swing part 108*a*.

Figure 11B:
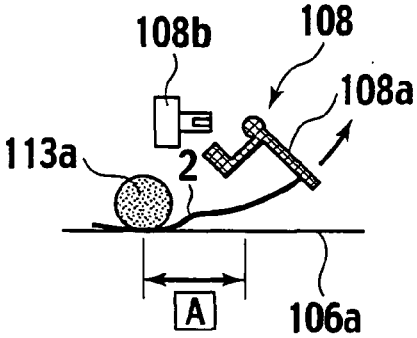

As described above, the lower end of the swing part 108*a* is kept away from the upper surface of the transfer belt 106*a* by the predetermined distance B, and kept away from the SS roller 113*a* by a distance "A" in the transfer direction. As shown in FIG. 11B, when the deformed printing sheet 2 leaves the upper surface of the transfer belt 106*a* after passing through the SS roller 113*a*, the leading end of the printing sheet contacts with the swing part 108*a* to push forward and swing the swing part 108*a*, so that the other end of the swing part 108*a* drops off from the swing sensor part 108*b*. It is therefore possible to detect the deformation of the printing sheet that exceeds the predetermined distance.

As shown in FIG. 5, there are provided a plurality of guide rollers 113*b*, 114*a*-117*a*, and 114*b*-117*b* along and across the transfer path. The guide roller 113*b* is disposed between the printing sheet sensor 108 and the ink-jet head 104*a*. The guide rollers 113*b*, 114*a*-117*a* and 114*b*-117*b* are disposed such that each of the plurality of ink-jet heads is to be arranged between each paired guide rollers for pressing the printing sheet transferred on the transfer path.

Figure 9:
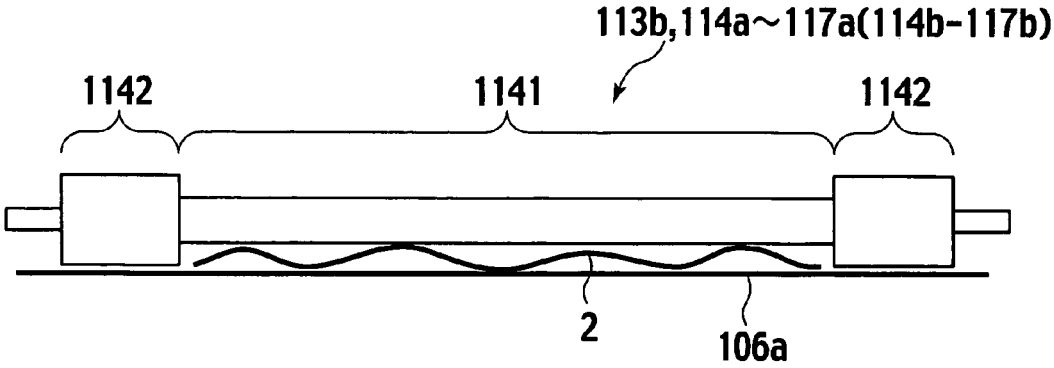
FIG. 9 is a front view showing the structure of a guide roller in the embodiment.
Figure 12:
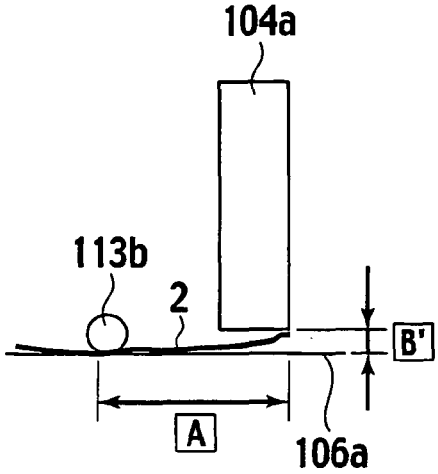
FIG. 12 is a side view showing the positional relationship between the guide roller and an ink-jet head in the embodiment.

As shown in FIG. 9, these guide rollers 113*b*, 114*a*-117*a* and 114*b*-117*b* comprise a central part 1141 and end parts 1142, 1142. The central part 1141 is large in diameter than the end parts so as to form a space between the central part 1141 and the upper surface of the transfer belt 106*a* when each roller contacts with the transfer belt 106*a*. As shown in FIG. 12, the lower end of the ink-jet head 104*a* (104*b*-104*d*) is kept by a predetermined distance "B'" from the upper surface of the transfer belt 106*a* and by a distance "A'" in the transfer direction from the adjacent guide roller 113*b* (114*b*-116*b*).

In this embodiment, the ratio between: a horizontal distance "A" (FIG. 11A) from the SS roller 113*a* to the swing part 108*a*; and a vertical distance "B" (FIG. 11A) from the upper surface of the transfer belt 106*a* to the lower end of the swing part 108*a*, is set approximately equal to the ratio between: a horizontal distance "A'" (FIG. 12) from the guide roller 113*b* to the ink-jet head 104*a*; and a vertical distance "B'" (head gap) (FIG. 12) from the upper surface of the transfer belt 106*a* to the lower end of the ink-jet head 104*a*.

As shown in FIG. 5, downstream of the transfer belt unit 106, there is provided a sheet discharging roller 118 facing to the transfer belt roller 106*b*. The sheet discharging roller 118 prevents the printing sheet 2, which is transferred by the transfer belt 106*a*, from leaving the transfer belt 106*a* before being transferred to the sheet discharging unit 109.

(Printing Unit)

The printing unit 102 (FIG. 4A) is a module for recording images on a predetermined printing sheet based on digital image signal generated by the image reading unit 101. In particular, as shown in FIGS. 4A and 5, the printing unit 102 comprises the ink-jet head unit 104, the transfer belt unit 106, and a double-side transfer belt unit 107. The ink-jet head unit 104 records images by ejecting ink on the printing sheet based on the digital image signal proceeded and output by the control unit 103. The transfer belt unit 106 has a transfer belt for transferring the printing sheet drawn from the sheet feeding unit 105 to the ink-jet head unit 104. The double-side transfer belt unit 107 transfers the printing sheet in double-side printing.

The image reading unit 101 reads an original image photoelectrically by a scanner and outputs digital image signal of "R", "G" and "B" components for each element. The digital image signal output by the image reading unit 101 is input to the control unit 103, and then the control unit 103 performs a predetermined image-processing. The processed digital image signal is output to the printing unit 102.

As shown in FIG. 5, the ink-jet head unit 104 comprises a plurality of ink-jet heads 104*a*-104*d* aligned above the transfer belt unit 106. In particular, according to the embodiment, the ink-jet head 104*b* is configured to eject ink that is thicker than that of the ink-jet head 104*a* and is disposed away from the transfer belt roller 106*b* by a distance "D". When elastic force of bending (described in detail below) of the printing sheet 2 is greater than adherence between the printing sheet 2 and the transfer belt 106*a*, the printing sheet 2 becomes misaligned from the transfer belt 106*a* in the transfer direction. The distance D is set long enough so that the printing sheet does not reach the ink-jet head 104*b* in the misaligned state.

It is possible to measure the distance D as follows, for instance. Obtain distances d1 and d2, and set a value greater than the sum of the distance d1 and d2 as the above distance D.

The distance d1 is obtained as follows. The difference between the peripheral velocity of the paired resistive rollers 111 and the peripheral velocity of the BU roller 112 forms bending of the printing sheet 2 between the paired resistive rollers 111 and the BU roller 112. When (at the moment) the trailing end of the printing sheet 2 leaves the paired resistive rollers 111, obtain a distance from the transfer belt roller 106*b* to the leading end (this leading end position is defined as "dx") of the printing sheet 2.

The distance d2 is obtained as follows. After the trailing end of the printing sheet 2 leaves the paired resistive rollers 111, the above bending gradually diminishes. At the state before the bending diminishes completely, the printing sheet does not stick to or is unlikely to stick to the transfer belt 106*a*. In this state, the printing sheet does not follow the peripheral velocity of the transfer belt 106*a*, and the elastic force of the bending of the printing sheet is greater than the adherence between the printing sheet and the transfer belt 106*a*.

When the printing sheet unbends completely (the printing sheet sticks to the transfer belt 106*a* completely), the printing sheet follows the peripheral velocity of the transfer belt 106*a* (the elastic force of bending of the printing sheet is smaller than the adherence between the printing sheet and the transfer belt 106*a*). At this moment, obtain the distance d2 from the above position dx to the leading end of the printing sheet. Note that the leading end of the printing sheet corresponds to a position where the printing sheet reaches when the elastic force of bending of the printing sheet becomes greater than the above adherence, so that the printing sheet is misaligned from the transfer belt 106*a* in the transfer direction.

The ink-jet head 104*a* is disposed between the BU roller 112, which is providing means, and the ink-jet head 104*b*.

In particular, these ink-jet heads 104*a*, 104*b*, 104*c*, 104*d* correspond to respective "C", "K", "M", and "Y" components of digital image in sequence from the feeding end. Each ink-jet head 104*a*-104*d* has two head units.

At each lower end of the ink-jet heads 104*a*-104*d*, there are provided a plurality of nozzles aligned every predetermined distance with their ink-jet nozzles downward. Inside each ink-jet head, there is provided an ink chamber (where ink tank provides ink) communicating with each nozzle and having piezoelectric element (piezo crystal) therein.

The piezoelectric element is driven by a jet control signal from the control unit 103 to change pressure within the ink chamber, so that the nozzle ejects ink. By ejecting ink droplet downward from the ink-jet nozzles, the ink-jet head unit 104 applies ink on an upper surface of the printing sheet.

Figure 4C:
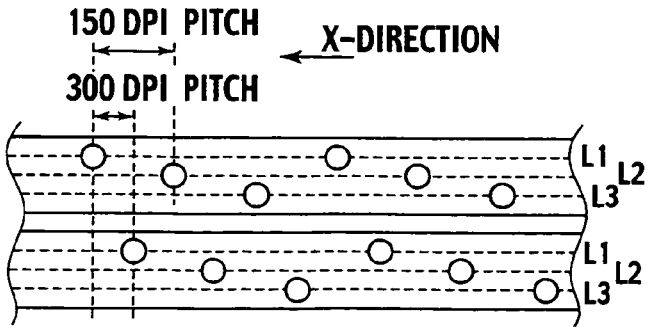
FIG. 4C is a top view showing head units in the embodiment.

Note that, as shown in FIG. 4C, each head unit has lines L1-L3 where ink-jet nozzles are arranged in an "X" direction (in a direction perpendicular to the transfer direction of the printing sheet) by 150 dpi pitch. Each of the ink-jet heads 104*a*-104*d* has two head units so that the ink-jet nozzles are arranged by 300 dpi pitch.

(Sheet Discharging Unit)

As shown in FIG. 5, the sheet discharging unit 109 has a transfer selecting unit 109*a*, paired discharging rollers 109*b*, and a sheet discharging tray 109*c* (FIG. 4A).

In response to a driving signal from the control unit 103, the transfer selecting unit 109*a* moves its end upward to lead the printing sheet 2 transferred by the transfer belt 106 to the sheet discharging unit 109, or moves its end downward to lead the printing sheet 2 to the double-side transfer belt unit 107. Downstream of the transfer belt roller 106*b* on the sheet feeding end, there is provided a sheet discharging path which leads the printing sheet 2 to the paired discharging rollers 109*b*. The peripheral velocity of the paired discharging rollers 109*b* is set faster than that of the transfer belt 106*a*. The printing sheet 2 transferred by the transfer belt 106*a* is therefore accelerated by the paired discharging rollers 109*b* to be stored on the sheet discharging tray 109*c*.

The double-side transfer belt unit 107 is formed by a looped belt 107*a* to transfer the printing sheet, which is printed on one side, to the printing unit 102 through a reverse path 122. The reverse path 122 has a path selecting unit 123 thereon. The path selecting unit 123 enables to send the printing sheet 2, transferred from the double-side transfer belt unit 107 through a transfer path 121, to and from the reverse path 122 so that its unprinted surface is turned up, and then send the turned-up sheet to the printing unit 102.

(Control Unit)

Figure 6:
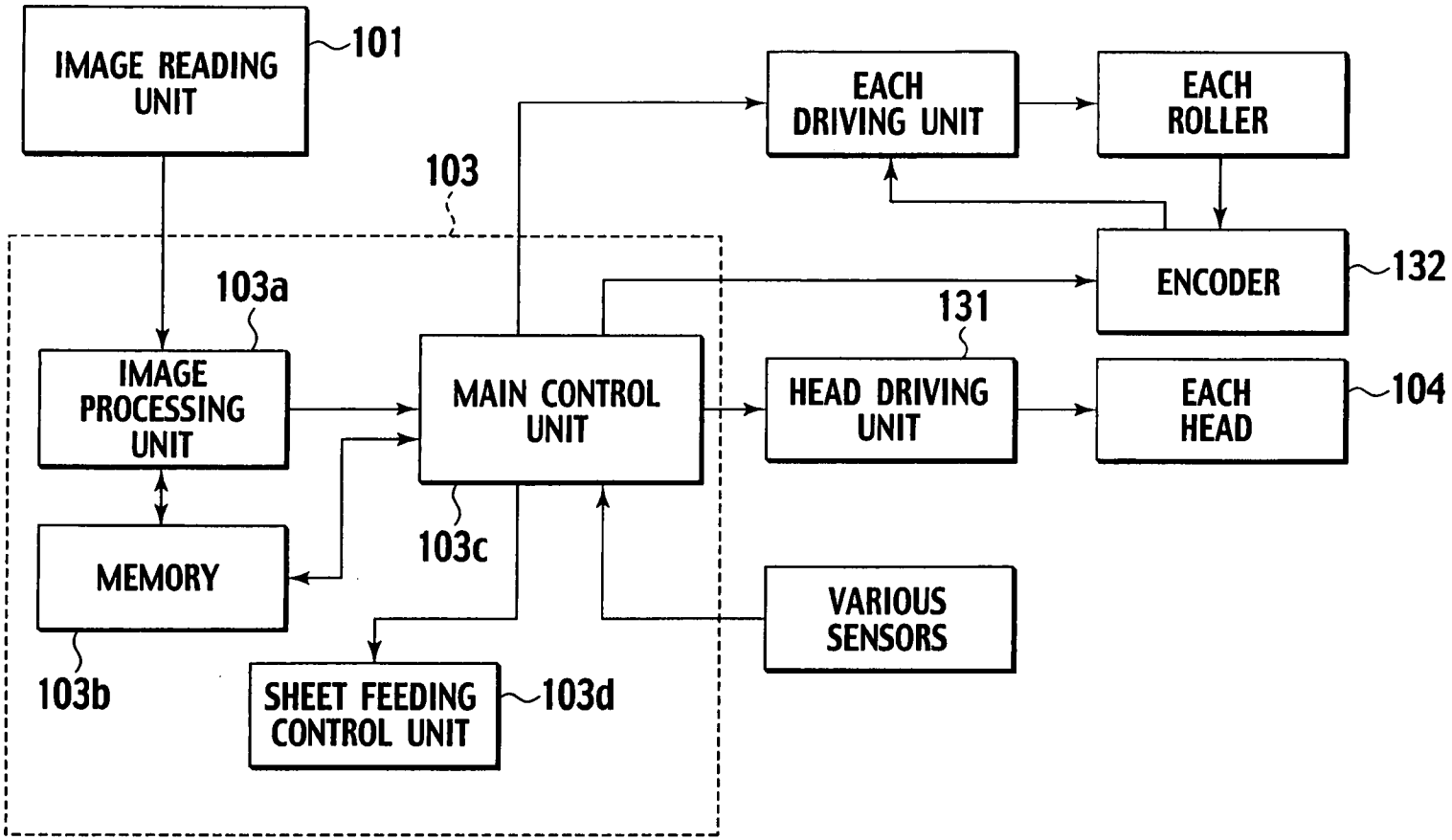
FIG. 6 is a block diagram showing the structure of a control unit in the embodiment.

FIG. 6 is a block diagram of showing the structure of the control unit 103. There is connected a PC (not shown) to the control unit 103. According to detected signals from various sensors, the control unit 103 controls: each driving unit which drives rotation of each roller; a head driving unit 131 which drives ink-jet operation of each ink-jet head 104*a*-104*d*; the transfer selecting unit 109*a*; and the path selecting unit 123.

The control unit 103 comprises: an image processing unit 103*a* which performs image-processing on the digital image signal input from the image reading unit 101; a memory unit or memory 103*b*; a sheet feeding control unit 103*d* controlling the feeding motion of the sheet feeding unit 105; and a main control unit 103*c* controlling each unit in response to signals from each sensor.

The image processing unit 103*a* converts digital image signals of R, G and B components of one image, which are output from the image reading unit 101, into digital image signals of Y (yellow), M (magenta), C (cyan), and K (black) components. The image processing unit 103*a* further converts each value of Y, M, C, and K components for each pixel of the digital image signals into data representing ink ejection amount, and saves them in the memory 103*b*. For example, the data corresponds to an ink ejection amount of each nozzle of each head (the number of ink ejection when the ejection amount from a nozzle is kept constant). The data also includes, related to each head, the number of rotation pulse from the time of detection by the printing sheet sensor, which is to be provided to each transfer driving unit. Note that ink ejection amount data is created for one image (of both sides) and deleted after the printing process by the main control unit, for instance.

The main control unit 103*c* detects rotation of each roller by sensors provided on the transfer belt unit 106, and performs controlling of each driving unit cooperatively with the encoder 132 which outputs pulse for a predetermined angle to the driving unit.

(Operation of Ink-Jet Printing Unit)

Operation of the ink-jet printing unit with the above structure is as follows.

First, a user specifies a double-side printing or a single-side printing on the PC (not shown). The specified information is sent to the control unit 103. Suppose that the single-side printing is specified. The main control unit 103*c* drives the transfer select unit 109*a* to move its end upward.

Next, when the user performs a print start operation, the image reading unit 101 executes an image reading process, and according to the above described converting process, the ink ejection amount data is saved in the memory 103*b*.

The main control unit 103*c* drives the driving end of the electromagnetic clutch 1058 to rotate through the drive transmission belt 1057 of the sheet feeding unit 105, synchronizing with driving units of respective units by the encoder 132. At the same time, the main control unit 103*c* provides a sheet feeding signal to the sheet feeding control unit 103*d* to start applying current to the electromagnetic clutch 1058 in response to the signal output from the sheet feeding timing sensor 202.

When applying current to the electromagnetic clutch 1058 is started, driving force of the driving end is transmitted to the driven end of the electromagnetic clutch 1058, so that the sheet feeding roller 105*b* is driven to rotate. With rotation of the sheet feeding roller 105*b*, the printing sheet at the top of the sheet feeding tray 105*a* is picked up, and fed and transferred along the lower guiding plate toward the paired resistive rollers 111.

The main control unit 103*c* also instructs each driving unit to drive each roller to rotate at the above predetermined velocity. In particular, the paired resistive rollers 111, the transfer belt roller 106*b*, and the sheet discharging roller 118 are driven to rotate (the peripheral velocity of the sheet discharging roller 118 is much greater than that of the paired resistive rollers 111 and that of the transfer belt roller 106*b*).

Note that when a plurality of overlapped printing sheets are picked up at once from the sheet feeding roller 105*b*, difference between: the frictional resistance between the printing sheets; and the frictional resistance between the printing sheet and the pad holder; enables to transfer only a top sheet toward the paired resistive rollers 111.

The difference between the peripheral velocity of the paired resistive rollers 111 and the peripheral velocity of the transfer belt 106*a* forms bending, between the paired resistive rollers 111 and the transfer belt 106*a*, of the printing sheet 2 sent from the paired resistive rollers 111. The transfer direction of the printing sheet 2 is corrected to the transfer direction of the transfer belt 106*a* by the BU roller 112. The printing sheet 2 is then sent to the SS roller 113*a*, which presses the central deformation of the printing sheet 2. The printing sheet 2 is then sent to the printing sheet sensor 108.

When the deformed printing sheet 2 leaves the upper surface of the transfer belt 106*a* after passing through the SS roller 113*a*, the leading end of the printing sheet contacts with the swing part 108*a* of the printing sheet sensor 108. The printing sheet sensor 108*a* is pushed forward to swing, so that the other end of the printing sheet sensor 108*a* drops off from the swing sensor part 108*b*, thereby detecting that the deformation of the printing sheet exceeds the predetermined volume. When the printing sheet sensor 108 detects the deformation of the printing sheet 2, the detection signal is sent to the main control unit 103*c*. The main control unit 103 instructs each driving unit to stop the rotation of each roller for a predetermined time. The printing sheet 2 that passes through the printing sheet sensor 108 without being detected of deformation is pressed by the SS roller 113*a* and sent to the ink-jet head 4.

The main control unit 113*c* obtains pulse signals output from the encoder 132, and then starts counting. The main control unit 113*c* also determines which nozzle performs ink ejection and which nozzle does not for each head, depending on the width of the printing sheet detected by the sensor, and gives instructions to the head driving unit 131. The main control unit 113*c* also refers to the ink ejection amount data, and when the count number reaches that of the ink-jet head, makes each nozzle perform ink ejection recorded number of times. This is performed at each ink-jet head every time the count number reaches that of each ink-jet head.

The printing sheet 2 on which each ink-jet head applied ink is sent to the sheet discharging tray 109*c* through: the transfer belt roller 106*b* on the discharging end; the sheet discharging roller 118; the discharging path; and the paired discharging rollers 109*b*.

Note that when the double-side printing is specified by the user, the left end (near end to the sheet discharging roller 118) of the transfer selecting unit 109*a* is moved downward. The transfer selecting unit 109*a* enables to transfer the printing sheet 2 on which each head applied ink, to the double-side transfer belt unit 107 by the paired rollers 120*a*, 120*b* on the transfer path 120. The printing sheet 2 is then turned up through the reverse path 122 so that the ink applied surface faces downward, and sent again to the paired resistive rollers 111 by each roller 124*a*, 124*b*. The subsequent operations are same as described above.

Figure 13:
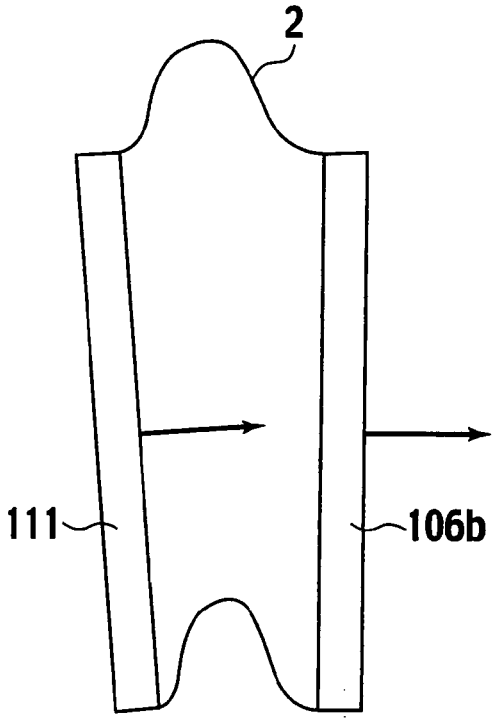
FIG. 13 is a view showing the bending mechanism of the printing sheet in the embodiment.

According to the embodiment described above, it is possible to prevent the damage of the printing sheets while realizing the high-speed printing, since the transfer direction is corrected by bending the printing sheet 2 and then absorbing or releasing the tension acting on the printing sheet 2. More particularly, it is difficult to assemble the BU roller 112 and the paired resistive rollers 111 absolutely parallel due to limitation of accuracy of the assembly. As shown in FIG. 13, the printing sheet slides in the transfer direction because the rollers are not parallel. According to the embodiment, it is possible to correct the transfer direction by bending the printing sheet 2 between the rollers and absorbing or releasing the tension acting on the printing sheet 2.

According to the embodiment, the ink-jet head 104*b* with dark-colored ink (in this case, black) deeper than that of the ink-jet head 104*a*, is arranged at a position away from a reaching position where the printing sheet 2 reaches after released from the bending. Thus, even though the printing sheet is misaligned from the transfer belt 106*a* in the transfer direction, only a light-colored ink ejected by the ink-jet head 104*a* is influenced. Since dark-colored ink is not influenced, it is possible to prevent debasement of the quality of printing. Note that the misalignment is caused because the elastic force of the bending of printing sheet 2 is greater than the adherence between the printing sheet 2 and the transfer belt 106*a*. Further, it is possible to miniaturize the device since the sheet feeding unit 105 is put closer to the ink-jet head unit 104.

Prevention of the debasement of the printing quality will be described in detail. According to the embodiment, the ink-jet head 104*a* is provided with the light-colored ink other than black. Printing with the light-colored ink by the ink-jet 104*a* becomes a base, on which printing with the dark-colored ink by the ink-jet head 104*b* is performed. As described above, when the printing sheet 2 is in the misaligned state after released from the bending, only the printing position of the light-colored ink is misaligned, and the printing position of the dark-colored ink is not misaligned.

As a result, when at least two colors out of four: one other than black on the sheet feeding end; and black are used, it is hard to discover dot misalignment. That is, it is hard to recognize the dot alignment when the dark-colored ink is applied on the light-colored ink than when the light-colored ink is applied on the dark-colored (black) ink.

This is because of a visual effect of human beings where a dark-colored part tends to catch eyes and to be recognized with emphasis. When a dark-colored area is wider than a light-colored area in an area, the dark-colored area draws attention. Moreover, even though the light-colored area is wider than the dark-colored area, the dark-colored area draws attention. Accordingly, the light-colored area corresponding to the misalignment is not easy to be recognized.

Near the paired resistive rollers 111 or the paired discharging rollers 109*b*, paper dust is often generated when these rollers rub against the surface of printing sheets. The paper dust is easy to stick to recording heads particularly on the sheet feeding end (ink-jet heads 104*a*) or the sheet discharging end (ink-jet head 104*d*). When these ink-jet heads on the sheet feeding end or the sheet discharging end eject black-colored ink on the printing sheets, the paper dust that is white is easy to be discovered in the black-colored image, thereby giving influence on images on the printing sheets. According to the embodiment, since colored ink other than black (light-colored ink such as Y) is arranged as the ink-jet head on the sheet feeding end or the sheet discharging end, it is possible to lower the influence on the printing sheets even though the paper dust sticks to these heads, compared to arranging black-colored ink on the sheet feeding end or the sheet discharging end.

According to the embodiment, it is therefore possible to realize high-speed printing with ink-jet heads and miniaturization of device, while preventing debasement of the printing quality caused by the misaligned ink position and the paper dust.

According to the embodiment, it is further possible to prevent the damage of the ink-jet head 104*a* by providing the printing sheet sensor 108 upstream of the ink-jet head 104*a*, detecting contact with the printing sheet having deformation volume over the predetermined volume by the sensor, and stopping the printing in response to the detection.

In particular, according to the embodiment, since the ratio between: the horizontal distance A from the SS roller 113*a* to the detecting part; and the vertical distance B from the upper surface of the transfer belt 106*a* to the lower end of the printing sheet sensor 108, is set approximately equal to the ratio between: the horizontal distance A' from the guide roller 113*b* to the ink-jet head; and the vertical distance B' from the upper surface of the transfer belt 106*a* to the lower end of the ink-jet head, it is possible to realize high-accuracy detection.

According to the embodiment, the guide roller 113*b* has a larger diameter at both ends (area other than sheet pressing area) than that of the central part, and rolls with both ends contacting with the transfer belt 106*a*. This enables the deformed printing sheet to be rolled in between the guide roller 113*b* and the transfer belt 106*a*, thereby stabilizing the transfer. On the other hand, the guide roller 113*b* has a smaller diameter at the sheet pressing area so as to prevent rubbing against the printing sheets. The deformation of printing sheets is not at the printing part but mainly at their edge, such as curl. Since printing is not performed on the edge, the printing part is not rubbed even though the printed sheet is rolled in downstream of the ink-jet head 104*a*.

Figure 14:
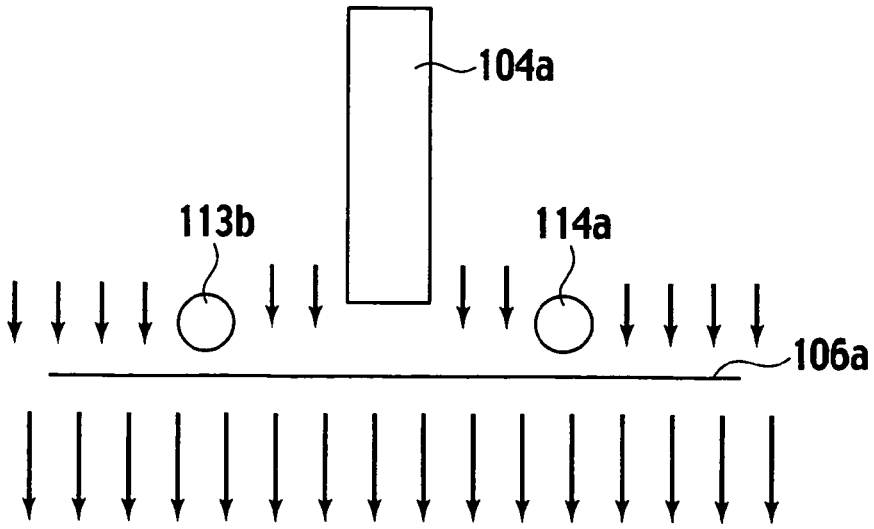
FIG. 14 is a view showing airflow near the ink-jet head in the embodiment.

In the above embodiment, since the guide rollers 113*b*-116*b* and 114*a*-117*a* are arranged as paired rollers having each ink-jet head between them, conditions of pressing the printing sheets is kept approximately equal upstream and downstream of each ink-jet head. This enables to prevent biased tension from acting on the printing sheets. As shown in FIG. 14, airflow around the ink-jet head 104*a* is made simple to reduce a rapid change of airflow, thereby preventing stains of fine ink in ejection.

Other Embodiments

Note that the present invention is not limited to the above embodiment, and it is possible to add the following modification.

For example, the number of ink-jet heads is not limited to four and may be other number. The position of the recording head with black-colored ink is not limited to the second from the sheet feeding end, but may be arranged closer to the sheet discharging end. The position of recording heads with colored-ink other than black is not limited to the above embodiment.

It is also possible to set the recording head at the sheet discharging end (head at the right most end) with black-colored ink and the recording head at the sheet feeding end with colored-ink other than black. In this case, the influence of the paper dust is not prevented, but the above other effects are realized.

In the embodiment, although the transfer of the printing sheet 2 is stopped when the deformation of the printing sheet 2 is detected, it is possible to: provide a discharging path for discharging the printing sheet from the transfer path upstream of the ink-jet head 104*a*; discharge the printing sheet when the deformation is detected without stopping the printing; re-transfer a new printing sheet; and perform printing on the new sheet.

According to the embodiment, it is possible to keep the printing quality and prevent the damage of ink-jet head by the sheet contacting with the head, by providing the detecting part upstream of the ink-jet head and detecting deformation of the sheet.

This application is based upon the Japanese Patent Applications No. 2005-322938, filed on Nov. 7, 2005, the entire content of which is incorporated by reference herein.

Although the present invention has been described above by reference to certain embodiments of the invention, this invention is not limited to these embodiments and modifications that will occur to those skilled in the art, in light of the teachings. The scope of the invention is defined with reference to the following claims.

What is claimed is:

1. An ink-jet printing machine comprising:

a transfer belt unit including an orbital transfer belt which serves as a transfer path of a printing sheet;

a sheet feeding unit configured to feed the printing sheet onto the transfer path;

an ink-jet head disposed above the transfer path and configured to perform ink ejection on the printing sheet transferred on the transfer path;

a sheet pressing roller disposed across the transfer path between the sheet feeding unit and the ink-jet head, and configured to press a central region of the printing sheet transferred on the transfer path;

a detecting unit disposed between the sheet pressing roller and the ink-jet head and away from an upper surface of the transfer belt by a predetermined distance, and configured to detect a deformation of the printing sheet that exceeds the predetermined distance by contacting with a deformed part of the printing sheet; and a guide roller disposed across the transfer path between the detecting unit and the ink-jet head and configured to press the printing sheet transferred on the transfer path;

wherein a ratio of a distance between the sheet pressing roller and the detecting unit to a distance between the upper surface of the transfer belt and the detecting unit is approximately equal to a ratio of a distance between the guide roller and the ink-jet head to a distance between the upper surface of the transfer belt and the ink-jet head.

2. The ink-jet printing machine of claim 1, wherein the guide roller comprises a central part and end parts, each end part having a larger diameter than that of the central part.

3. The ink-jet printing machine of claim 1, wherein the detecting unit comprises:

a swing part supported to swing in a transfer direction of the printing sheet with one end extending toward the surface of the transfer belt; and a swing sensor part configured to detect that the other end of the swing part is disengaged from the swing sensor part.

4. An ink-jet printing method providing a printing sheet on a transfer path formed by an orbital transfer belt, transferring the printing sheet along the transfer path, performing ink ejection from an ink-jet head disposed above the transfer path on the printing sheet transferred on the transfer path, the method comprising:

pressing a central region of the printing sheet transferred on the transfer path by a sheet pressing roller disposed across the transfer path between a sheet feeding unit and the ink-jet head;

detecting a deformation of the printing sheet exceeding a predetermined distance by contact of a deformed part of the printing sheet and a detecting unit, which is disposed between the sheet pressing roller and the ink-jet head and away from an upper surface of the transfer belt by the predetermined distance; and pressing the printing sheet transferred on the transfer path by a guide roller disposed across the transfer path and between the detecting unit and the ink-jet head;

wherein a ratio of a distance between the sheet pressing roller and the detecting unit to a distance between the upper surface of the transfer belt and the detecting unit is set approximately equal to a ratio of a distance between the guide roller and the ink-jet head to a distance between the upper surface of the transfer belt and the ink-jet head.

5. The ink-jet printing method of claim 4, further comprising: detecting the contact of the deformed part of the printing sheet and the detecting unit when a member of the detecting unit swings in a transfer direction of the printing sheet, thereby being disengaged from the detecting unit.

6. An ink-jet printing machine comprising:

a transfer belt unit including an orbital transfer belt which serves as a transfer path of a printing sheet;

a sheet feeding unit configured to feed the printing sheet onto the transfer path;

an ink-jet head disposed above the transfer path and configured to perform ink ejection on the printing sheet transferred on the transfer path;

a sheet pressing roller disposed across the transfer path between the sheet feeding unit and the ink-jet head and configured to press a central region of the printing sheet transferred on the transfer path; and a detecting unit disposed between the sheet pressing roller and the ink-jet head and away from an upper surface of the transfer belt by a predetermined distance and configured to detect a deformation of the printing sheet that exceeds the predetermined distance by contacting with a deformed part of the printing sheet, wherein the detecting unit comprises:

a swing part supported to swing in a transfer direction of the printing sheet with one end extending toward the surface of the transfer belt; and a swing sensor part configured to detect that the other end of the swing part is disengaged from the swing sensor part.

* * * * *